US005123822A

United States Patent [19]

Yoshimura

[11] Patent Number: 5,123,822

[45] Date of Patent: Jun. 23, 1992

[54] SCREW COMPRESSOR WITH SPACER TO PREVENT MOVEMENT OF VOLUME ADJUSTING VALVE

[75] Inventor: Shoji Yoshimura, Kakogawa, Japan

[73] Assignee: Kabushiki Kaisha Kobe Seiko Sho, Kobe, Japan

[21] Appl. No.: 671,377

[22] Filed: Mar. 12, 1991

[30] Foreign Application Priority Data

Jun. 30, 1990 [JP] Japan ..... 2-174207

[51] Int. Cl.[5] ..... F04C 18/16; F04C 29/00

[52] U.S. Cl. ..... 418/201.2; 418/270

[58] Field of Search ..... 418/201.1, 201.2, 201.3, 418/270

[56] References Cited

U.S. PATENT DOCUMENTS

| | | | |
|---|---|---|---|
| 3,412,089 | 3/1969 | Schibbye | 418/201.2 |
| 4,076,468 | 2/1978 | Persson et al. | 418/201.2 |
| 4,180,089 | 12/1979 | Webb | 418/203 |
| 4,519,748 | 5/1985 | Murphy et al. | 418/201.2 |
| 4,575,323 | 3/1986 | Yoshimura | 418/201.2 |
| 4,609,329 | 9/1986 | Pillis et al. | 418/201.2 |
| 4,964,790 | 10/1990 | Scott | 418/201.2 |

FOREIGN PATENT DOCUMENTS

| | | | |
|---|---|---|---|
| 2318467 | 4/1973 | Fed. Rep. of Germany . | |
| 271735 | 9/1989 | German Democratic Rep. | 418/201.2 |
| 57-159993 | 10/1982 | Japan . | |
| 58-051290 | 3/1983 | Japan . | |
| 62-023590 | 1/1987 | Japan . | |
| 2119446 | 11/1983 | United Kingdom | 418/201.2 |

*Primary Examiner*—Richard A. Bertsch
*Assistant Examiner*—David L. Cavanaugh
*Attorney, Agent, or Firm*—Oblon, Spivak, McClelland, Maier & Neustadt

[57] ABSTRACT

A screw compressor comprises a pair of screw rotors provided in a casing, a cylinder fixed to the casing and having a first chamber and a second chamber, a first piston fitted in the first chamber, a second piston fitted in the second chamber, a built-in volume ratio adjusting valve operated by the first piston, a volume control slide valve operated by the second piston, a stopper fixed to the casing to limit the backward movement of the built-in volume ratio adjusting valve, and a volume control slide valve. When built-in volume ratio adjustment is unnecessary, the built-in volume ratio adjusting valve is held immovable between the stopper and a spacer fixed to the built-in volume ratio adjusting valve and resting on a fixed surface of the casing. All the forces acting on the immovable built-in volume ratio adjusting valve are sustained by the casing, so that the rest of the components of the screw compressor are not exposed to excessive forces.

3 Claims, 3 Drawing Sheets

SCREW COMPRESSOR WITH SPACER TO PREVENT MOVEMENT OF VOLUME ADJUSTING VALVE

BACKGROUND OF THE INVENTION

1. Field of the Invention

The present invention relates to a screw compressor provided with a built-in volume ratio adjusting valve and a volume control slide valve.

2. Description of the Related Art

FIG. 3 shows a conventional screw compressor provided with a built-in volume ratio adjusting valve 11 and a volume control slide valve 12. This screw compressor comprises: a casing 15 provided with a suction port 13 and a discharge port 14; a pair of intermeshing, counterrotating screw rotors 16 disposed within and journaled on the casing 15; a cylinder 22 fixed to the casing 15, provided with a partition wall 17 held in place with snap rings and partitioning the interior of the cylinder 22 into a first chamber 18 on the near side with respect to the rotors 16, provided with an inlet port 20X and an outlet port 20Y for the working fluid, and a second chamber 19 on the far side with respect to the rotors 16, provided with an inlet port 21X and an outlet port 21Y for the working fluid; a first piston 24 fitted in the first chamber 18 for axial sliding motion; a second piston 25 fitted in the second chamber 19 for axial sliding motion; a first piston rod 26 having one end joined to the first piston 24 and the other end operatively connected to the built-in volume ratio adjusting valve 11 to move the inner volume adjusting valve 11 in a space between the rotors 16 and the inner surface of the casing 15; a second piston rod 27 having one end joined to the second piston 25 and the other end operatively connected to the volume control slide valve 12 to move the volume control slide valve 12 in a space between the rotors 16 and the inner surface of the casing; a stopper 28 formed integrally with the casing 15 to limit the backward movement of the built-in volume ratio adjusting valve 11. The second piston rod 27 is extended through the first piston rod 26 for sliding movement relative to the first piston rod 26. The volume control slide valve 12 is able to move in the operating range of the built-in volume ratio adjusting valve 11 or in the extension of the operating range of the built-in volume ratio adjusting valve 11. The backward movement of the volume control slide valve 12 is limited by the built-in volume ratio adjusting valve 11. In a state shown in FIG. 3, the first piston 24 is held immovable by spacers 29. The spacers 29 are removed when built-in volume ratio adjustment is necessary.

The adiabatic efficiency of the screw compressor reaches a maximum when $$Vi^{\kappa} = Pd/Ps$$

where $Vi = V_1/V_0$, $V_1$ is theoretical maximum thread volume, $V_0$ is theoretical minimum thread volume at the opening of the outlet port, Pd/Ps is external pressure ratio, Pd is discharge pressure, Ps is suction pressure and $\kappa$ is the ratio of specific heat.

When the built-in volume ratio of the compressor needs to be increased to achieve the maximum adiabatic efficiency, the built-in volume ratio adjusting valve 11 is moved to the right, as viewed in FIG. 3, and, when the built-in volume ratio needs to be decreased for the same purpose, the built-in volume ratio adjusting valve 11 is moved to the left. For full load operation, the volume control slide valve 12 is placed contiguously with the built-in volume ratio adjusting valve 11 as shown in FIG. 3 to compress all the sucked gas and to discharge the same through the discharge port 14. For partial load operation or no-load operation only the volume control slide valve 12 is moved to the right so that a gap is formed between the built-in volume ratio adjusting valve 11 and the volume control slide valve 12 to return part of or all the gas sucked through the suction port 13 to the suction port 13 without compressing the gas.

When the screw compressor is operated under a condition where the suction pressure and the discharge pressure do not vary very much, the built-in volume ratio need not be adjusted by the built-in volume ratio adjusting valve 11. Accordingly, the spacers 29 are placed on both sides of the first piston 24 in the first chamber 18 to hold the first piston 24 immovable and to hold the built-in volume ratio adjusting valve 11 at a fixed position. This conventional screw compressor, however, has a problem that a large force acting on the built-in volume ratio adjusting valve 11 from the side of the rotors 16 is transmitted through the first piston rod 26, the first piston 24, the spacer 29 and the partition wall 17 and acts on the snap ring 23, and hence the snap ring 23 is liable to be damaged.

SUMMARY IF THE INVENTION

Accordingly, it is an object of the present invention to provide a screw compressor provided with a built-in volume ratio adjusting valve and incorporating improvements for securely fixing the built-in volume ratio adjusting valve.

In one aspect of the present invention, a screw compressor comprises: a casing; a pair of intermeshing, counterrotating screw rotors disposed within and journaled on the casing; a cylinder fixed to the casing and provided with a fixed partition wall partitioning the interior of the cylinder into a first chamber on the near side with respect to the screw rotors, provided with an inlet port and an outlet port for the working fluid, and a second chamber on the far side with respect to the screw rotors, provided with an inlet port and an outlet port for the working fluid; a first piston fitted in the first chamber for axial sliding movement; a second piston fitted in the second chamber for axial sliding movement; a first piston rod joined to the first piston; a built-in volume ratio adjusting valve operated through the first piston rod by the first piston for movement in a space between the screw rotors and the inner surface of the casing; a stopper formed integrally with the casing or fixed to the casing to limit the backward movement of the built-in volume ratio adjusting valve; a second piston rod joined to the second piston and extended through the first piston rod for axial sliding movement relative to the first piston rod; and a volume control slide valve operated through the second piston rod by the second piston for movement in a space between the screw rotors and the inner surface of the casing in the operating range of the built-in volume ratio adjusting valve or in the extension of the operating range of the built-in volume ratio adjusting slide valve, the backward movement of the volume control valve being limited by the built-in volume ratio adjusting valve; wherein a spacer is fixed at least to either the built-in volume ratio adjusting valve or the first piston rod, and to the casing so as to be immovable in the operating direction of the built-in volume ratio adjusting valve relative to the built-in volume ratio adjusting valve and the casing.

In this configuration, all the forces applied by the fixed built-in volume ratio adjusting valve to the spacers is sustained by the casing, and hence the rest of the components are not exposed to excessive forces.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Figure 1:
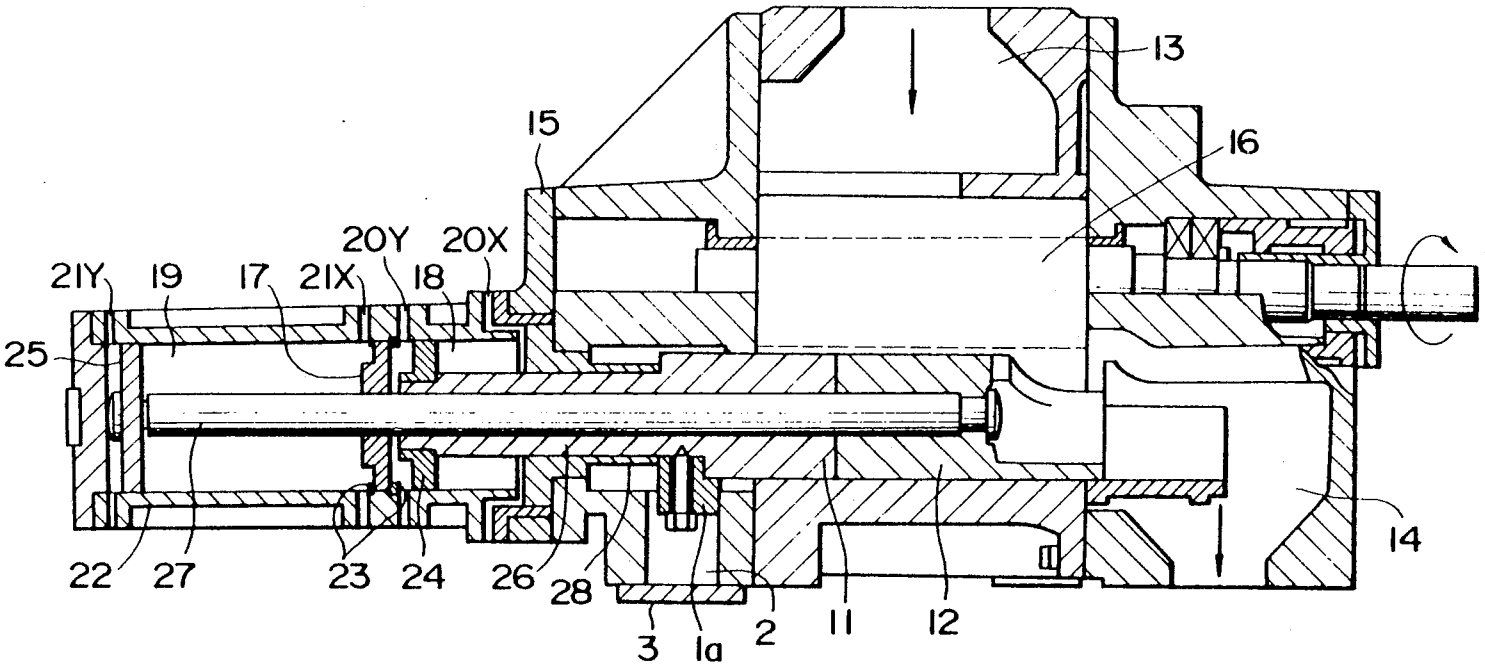
FIG. 1 is a sectional view of a screw compressor in a first embodiment according to the present invention.
Figure 3:
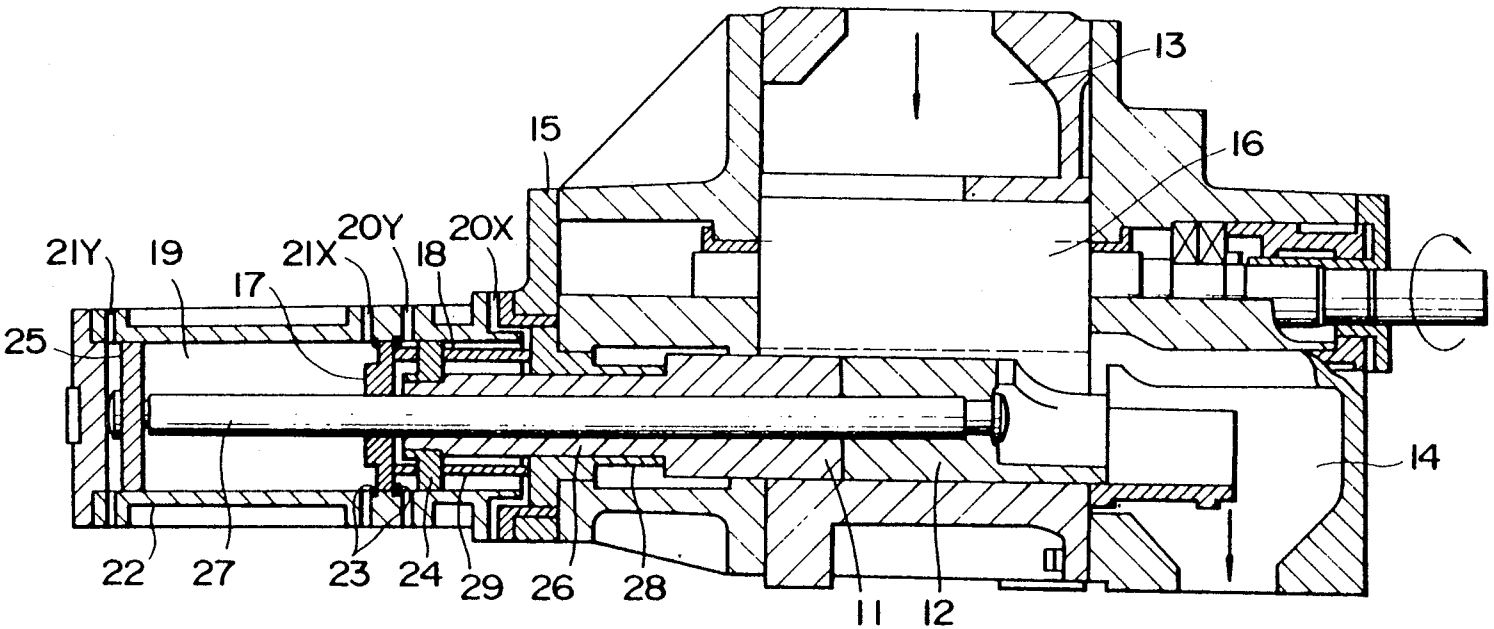
FIG. 3 PRIOR ART
FIG. 3 is a sectional view of a conventional screw compressor.

A screw compressor in a first embodiment according to the present invention shown in FIG. 1 is substantially the same in construction as the conventional screw compressor shown in FIG. 3, except that the screw compressor embodying the present invention is provided with a spacer 1*a* instead of the spacers 29 of the conventional screw compressor, and has a shape conforming to the employment of the spacer la. Therefore, parts shown in FIG. 1 like or corresponding to those described with reference to FIG. 3 are denoted by the same reference characters and the description thereof will be omitted.

Referring to FIG. 1, the spacer la is disposed between a built-in volume ratio adjusting valve 11 and a stopper 28 and is fastened to the built-in volume ratio adjusting valve 11 with a bolt with its surface on the far side with respect to the stopper 28 in contact with the side surface of a spacer inserting hole 2. Thus, a force acting on the built-in volume ratio adjusting valve 11 to the left, as viewed in FIG. 1, is sustained by the stopper 28, and a force acting on the built-in volume ratio adjusting valve 11 to the right, as viewed in FIG. 1, is sustained by the side surface of the spacer inserting hole 2. The spacer inserting hole 2 is closed with a cover plate 3.

Figure 2:
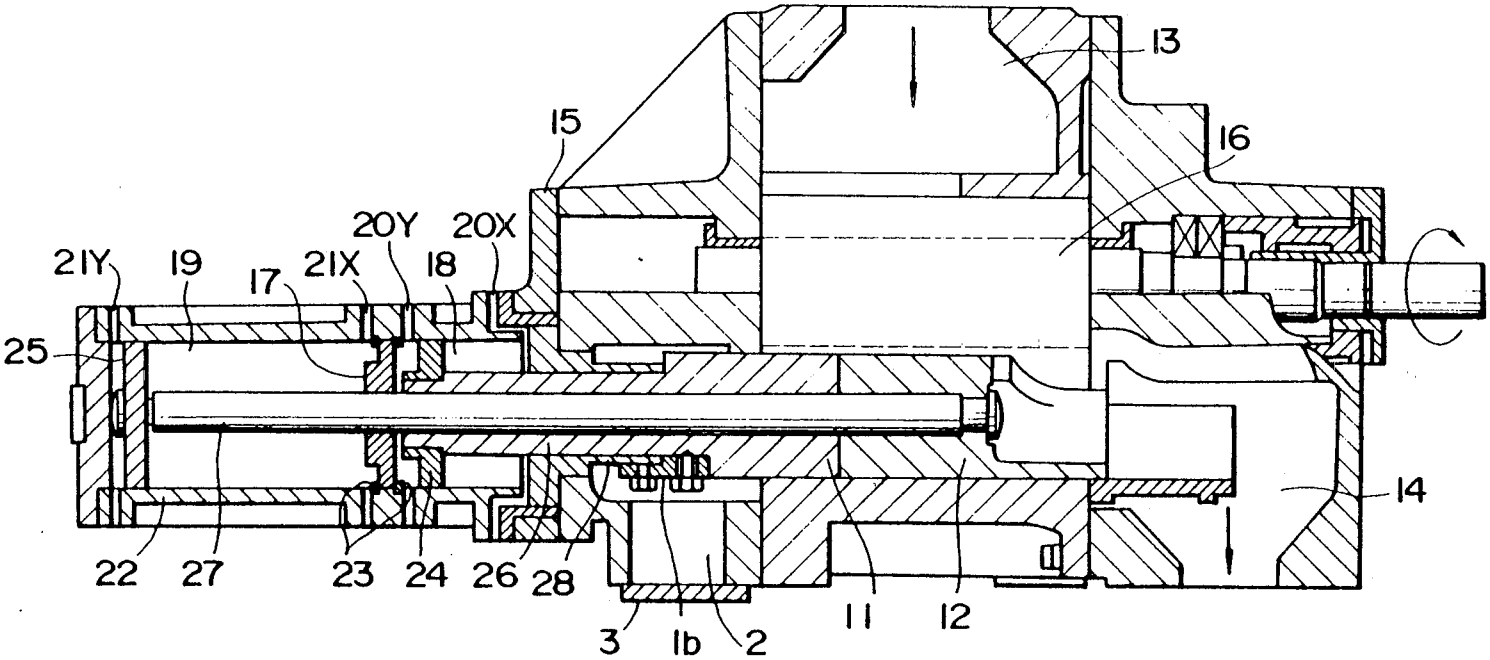
FIG. 2 is a sectional view of a screw compressor in a second embodiment according to the present invention.

A screw compressor in a second embodiment according to the present invention shown in FIG. 2 is substantially the same in construction as the screw compressor shown in FIG. 1, except that the screw compressor in the second embodiment employs a spacer 1*b* fastened to a built-in volume ratio adjusting valve 11 and a stopper 28 with bolts instead of the spacer la, and hence parts like of corresponding to those shown in FIG. 1 are denoted by the same reference characters and the description thereof will be omitted.

In this screw compressor both forces acting in opposite directions on the built-in volume ratio adjusting valve 11 are sustained by the stopper 28.

As is apparent from the foregoing description, according to the present invention, the spacer is fastened at least to either the built-in volume ratio adjusting valve or the first piston rod, and to the casing so as to be immovable in the operating direction of the built-in volume ratio adjusting valve relative to the built-in volume ratio adjusting valve and the casing, so that force acting on the fixed built-in volume ratio adjusting valve is sustained directly by the casing. Accordingly, the rest of the components are not exposed to excessive forces and the built-in volume ratio adjusting valve can be securely fixed.

Although the invention has been described in its preferred forms with a certain degree of particularity, obviously many changes and variations are possible therein. It is therefore to be understood that the present invention may be practiced otherwise than as specifically described herein without departing from the scope and spirit thereof.

What is claimed is:

1. A screw compressor comprising:

a casing;

a pair of intermeshing, counterrotating screw rotors disposed within and journaled on the casing;

a cylinder fixed to the casing and provided with a fixed partition wall partitioning the interior of the cylinder into a first chamber on the near side with respect to the screw rotors, provided with an inlet port and an outlet port for the working fluid, and a second chamber on the far side with respect to the screw rotors, provided with an inlet port and an outlet port for the working fluid;

a first piston fitted in the first chamber for axial sliding movement;

a second piston fitted in the second chamber for axial sliding movement;

a first piston rod joined to the first piston;

a built-in volume ratio adjusting valve operated via the first piston rod by the first piston for movement in an operating direction in a space between the screw rotors and the inner surface of the casing for adjusting a built-in volume ratio of said compressor;

a stopper formed integrally with the casing or fixed to the casing to limit the backward movement of the built-in volume ratio adjusting valve;

a second piston rod joined to the second piston and extended through the first piston rod for axial sliding movement relative to the first piston rod;

a volume control slide valve operated via the second piston rod by the second piston for movement in a space between the screw rotors and the inner surface of the casing in the operating range of the built-in volume ratio adjusting valve or in the extension of the operating range of the built-in volume ratio adjusting valve, the backward movement of the volume control slide valve being limited by the built-in volume ratio adjusting valve; and a spacer connected to one from the group consisting of the built-in volume ratio adjusting valve and the first piston rod, and immovable with respect to the casing in the operating direction of the built-in volume ratio adjusting valve such that the built-in volume ratio adjusting valve is fixed relative to the casing.

2. The screw compressor of claim 1 wherein said spacer is connected to said first piston rod and extends into a spacer inserting hole in the casing, said spacer abutting said stopper and a wall of said spacer inserting hole so as to fix said built-in volume ratio adjusting valve in the operating direction thereof.

3. The screw compressor of claim 1 wherein said spacer is connected to said first piston rod and to said stopper.

* * * * *